United States Patent [19]

Sutton

[11] Patent Number: 5,062,161

[45] Date of Patent: Nov. 5, 1991

[54] METHOD OF MAKING GARMENT, GARMENT AND STRAND MATERIAL

[75] Inventor: Roger I. Sutton, Bermuda Run, N.C.

[73] Assignee: Golden Needles Knitting and Glove Co., Inc., Wilkesboro, N.C.

[21] Appl. No.: 668,813

[22] Filed: Mar. 8, 1991

Related U.S. Application Data

[63] Continuation of Ser. No. 285,403, Dec. 16, 1988, abandoned.

[51] Int. Cl.[5] ..... A41D 19/02; D04B 7/34

[52] U.S. Cl. ..... 2/169; 66/174; 66/202

[58] Field of Search ..... 2/169; 66/174, 202

[56] References Cited

U.S. PATENT DOCUMENTS

| | | | |
|---|---|---|---|
| 2,052,875 | 9/1936 | Gammons et al. | 28/1 |
| 2,156,549 | 5/1939 | Smith, Jr. | 66/202 |
| 2,332,738 | 10/1943 | Meade | 28/168 X |
| 2,412,562 | 12/1946 | Crawshaw | 139/425 |
| 2,609,569 | 9/1952 | Walter et al. | 18/54 |
| 2,942,442 | 6/1960 | Michael-Lohs | 66/202 X |
| 3,087,699 | 4/1963 | Foster | 245/2 |
| 3,131,469 | 5/1964 | Glaze et al. | 29/470.5 |
| 3,146,576 | 9/1964 | Wezel | 57/160 |
| 3,288,175 | 11/1966 | Valko | 139/425 |
| 3,378,999 | 4/1968 | Roberts | 57/139 |
| 3,562,374 | 2/1971 | Okamoto et al. | 264/128 |
| 3,565,127 | 2/1971 | Doyle et al. | 139/426 |
| 3,699,768 | 10/1972 | Roberts et al. | 57/144 |
| 3,882,667 | 5/1975 | Barry | 28/76 T X |
| 3,908,250 | 9/1975 | Agan, Jr. et al. | 28/76 T |
| 3,953,913 | 5/1976 | Brown et al. | 28/76 P |
| 4,033,151 | 7/1977 | Jansen | 66/147 |
| 4,064,915 | 12/1977 | Buyssens et al. | 139/425 R |
| 4,384,449 | 5/1983 | Byrnes, Sr. et al. | 2/167 X |
| 4,470,251 | 9/1984 | Bettcher | 2/167 X |
| 4,551,860 | 11/1985 | Smit et al. | 2/175 |
| 4,570,311 | 12/1986 | Kawamura et al. | 28/164 |

FOREIGN PATENT DOCUMENTS

| | | | |
|---|---|---|---|
| 71-23592 | 7/1971 | Japan | 66/202 |
| 46-23592 | 7/1971 | Japan | 66/202 |
| 52-74072 | 6/1977 | Japan | 28/168 |
| 53-4452 | 2/1978 | Japan | 139/425 P |
| 53-126336 | 11/1978 | Japan . | |
| 53-143750 | 12/1978 | Japan . | |
| 3143750 | 12/1978 | Japan | 28/168 |
| PCT84/00020 | 3/1985 | PCT Int'l Appl. . | |
| 10077 | of 1897 | United Kingdom | 139/425 R |

OTHER PUBLICATIONS

"Metex," *Knitting Times,* vol. 40 No. 28, Jul. 5, 1971, pp. 24–25.

"Textile Applications for Fine Metallic Filaments," Modern Textile Papers of the AATT (Mar. 1974), B. Allen, Two Pages.

"Stainless Steel–Fibre of the Future?" Man–Made Textiles vol. 43, No. 499, p. 33 (Jan. 1966).

*Primary Examiner*—Werner H. Schroeder
*Assistant Examiner*—Sara M. Current
*Attorney, Agent, or Firm*—Spencer & Frank

[57] ABSTRACT

This invention relates to a method of making a protective garment, a garment produced in accordance with the method, and a strand material used in the method and garment. The strand material comprises entwined strands of metallic material such as a multifilament bundle of continuous filament stainless steel and a transistory material such as polyvinyl alcohol or polyester which can be removed by agents which are harmless to the metallic material. The method comprises manipulating the strand material using substantially conventional textile fabric forming technology such as knitting to form a fabric and a garment, and may include coating the finished garment with coating to achieve enhanced characteristics. The garments may be in the form of gloves, sleeves, aprons and the like.

13 Claims, 1 Drawing Sheet

METHOD OF MAKING GARMENT, GARMENT AND STRAND MATERIAL

This application is a continuation of application Ser. No. 07/285,403, filed Dec. 16th, 1988.

FIELD AND BACKGROUND OF INVENTION

This invention relates to a method of making a protective garment, a garment produced in accordance with the method, and a strand material used in the method and garment.

Protective garments have been well known and widely used in a number of applications and fields. By way of example, protective garments in the form of gloves are shown in Michael-Lohs U.S. Pat. No. 2,942,442; Byrnes U.S. Pat. No. 4,384,449; and Bettcher U.S. Pat. No. 4,470,251. The technology of making such protective garments disclosed in those prior patents has been applied to other similar types of garments, such as arm protectors made in the form of open ended tubes, aprons, shirts and the like.

While protective garments made as described in the aforementioned prior patents have achieved some success and acceptance, such garments have limitations in protecting wearers against injury from slashing and penetrating cuts. Such limitations may become of particular significance where such injuries may have the major secondary risk of opening the skin of a wearer to bacterial or viral infection, such as is the case with medical applications and the like. For these reasons, enhancement of the cut resistance of a protective garment is a constantly sought goal.

The prior patents suggest that cut resistance be sought by the use, in making protective garments, of high strength strand materials such as aramid fibers and metallic strands covered with synthetic strands. In the making of such garments, any metallic strands present have been and are covered in such a way as to be present only in the interior of the strand materials and thus serve a core strengthening purpose at most. The metallic strands present have not appeared at the surface of the garments where engagement with the cutting instrumentalities affecting the garment would occur. This has been the case due to the impossibility of manipulating the metallic strands in the conventional textile fabric forming processes used to make the garments, and particularly (in the case of the gloves disclosed in the patents mentioned above) knitting the metallic strands.

BRIEF DESCRIPTION OF INVENTION

With the foregoing particularly in mind, it is an object of this invention to provide a protective garment having enhanced cut resistance. In realizing this object of this invention, a protective garment is made in which the garment consists essentially entirely of a metallic strand, thereby gaining the cut resistance of metallic materials.

A further object of this invention is to manufacture a protective garment of the type described by processes which follow essentially conventional textile fabric manufacturing processes. In realizing this object of the present invention, a metallic strand material is manipulated in accordance with conventional practice followed for non-metallic strands. Such manufacture has been impossible prior to the present invention.

Yet a further object of this invention is to provide a strand material which can be manipulated in accordance with conventional practice as used with non-metallic strands to produce protective garments of the types described. In realizing this object of the present invention, a strand material is produced which has a metallic strand component entwined with a fugitive non-metallic strand component which is removable by subjecting a fabric formed of the strand material to processes which are non-injurious to the metallic strand component while removing the non-metallic strand component.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
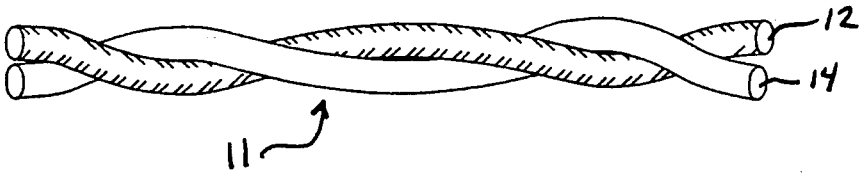
FIG. 1 is an elevation view of a strand material in accordance with this invention.
Figure 2:
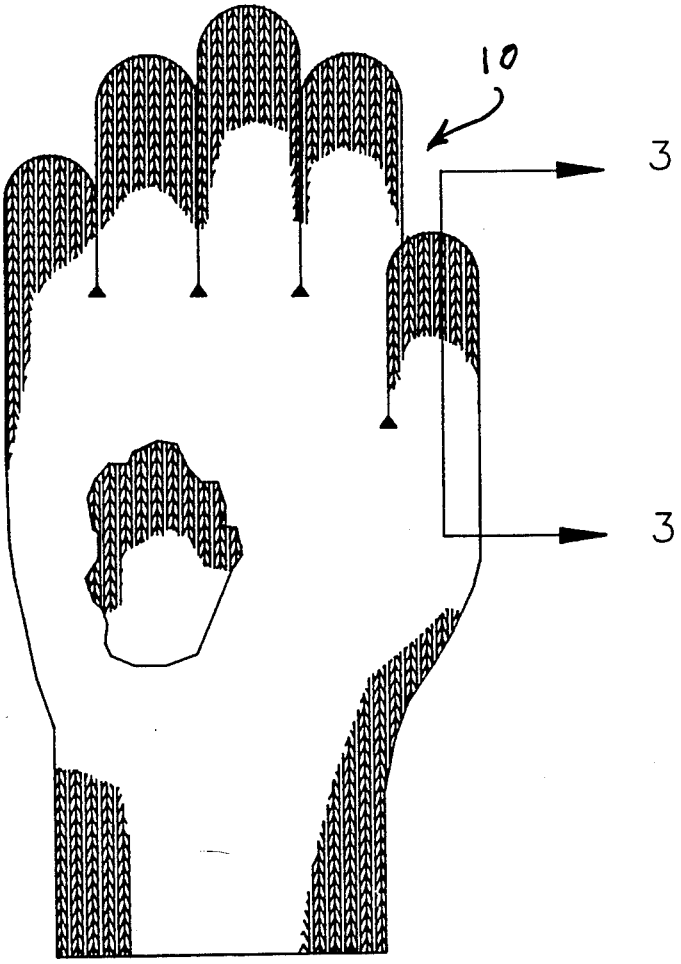
FIG. 2 is an elevation view, partly broken away, of a protective garment as contemplated by the invention and made using the strand material of FIG. 1.

Referring now more particularly to the accompanying drawings, a protective garment in accordance with this invention is there shown in FIG. 2 and identified at 10. The garment (in the illustrated case, a glove) is made using a strand material as indicated at 11 in FIG. 1. The method of making the garment is essentially based upon conventional textile techniques. However, the method is particularly characterized by the steps of providing a strand material (the material 11 of FIG. 1) which is formed by a multifilament bundle 12 of continuous metallic strands entwined with a transitory strand 14 soluble in agents which have substantially no effect on the metallic strands, manipulating the strand material 11 to form a textile fabric and fabricating the textile fabric into a garment, and treating the textile fabric with an agent for removing the transitory strand 14 so as to leave only the multifilament bundle 12 of continuous metallic strands forming the fabric.

In development of this invention up to the time of preparation of this description, the metallic strands have been formed of stainless steel extruded in bundles of continuous filaments. One suitable material has 275 filaments bundled into a strand material approximately comparable to a 12 singles strand as identified on the cotton count system. Another has 90 filaments bundled into a strand approximately comparable to a 14 singles strand. In each instance, the stainless steel material is annealed after extrusion and before plying and manufacture of a garment in order to enhance the flexibility of the composite strand in undergoing manufacturing procedures.

The non-metallic strand component 14 entwined with the metallic strand component 12 has been of two types, a water soluble polyvinyl alcohol and polyester. As will be brought out more fully hereinafter, selection of the non-metallic strand material is made depending in part on the final application of the protective garment to be made.

A significant element of the present invention lies in the fact that the composite strand material 11 may be fabricated in a garment, and particularly a glove as illustrated, by knitting the strand material into a fabric. In the instances of a glove or arm shield, the strand material is knit into a tubular fabric using either a circular knitting machine or a glove knitting machine of known types. Stitch sizes in such machines may, for example only, be in the range of 7 to 13 cut. In knitting such fabrics using the strand material 11, the process includes passing the strand material through a knitting machine and lubricating the knitting machine and facilitating manipulation of the strand material by the inclusion of the transitory strand 14. The precise mechanism by which the presence of the transistory strand 14 serves to lubricate and facilitate the manipulation of the metallic strand is not fully understood. However, it has been observed that the metallic strands cannot be manipulated as required for fabric formation absent the transistory strand and that there may be some melting of the transistory strand material during fabric formation. It is believed that the presence of the transistory strand enables the composite strand to bend and move over machine elements such as knitting needles and over intersecting strands while avoiding severance of the metallic strand on itself or engaged machine elements.

As will have become clear from the discussion above, use of the composite strand material 11 of this invention enables the fabrication of protective garments using essentially conventional textile techniques such as knitting. Such a garment preferably takes the form of a glove, as illustrated at 10 in FIG. 2. However, it is contemplated that the garment may take other forms, including without limitation arm shields, aprons and the like. In all such instances, the protective garment contemplated by this invention will comprise, at a point during its manufacture, a body 10 of a strand material 11 formed by a multifilament bundle 12 of continuous metallic strands entwined with a transitory strand 14 soluble in liquid agents which have substantially no effect on the metallic strands, the strand material forming a textile fabric. For gloves and certain other products, the strand material is knit into loops forming courses and wales.

The protective garments have a range of applications. One derives from the electrically conductive nature of the stainless steel metallic strand component. Due to that electrically conductive nature, garments made in accordance with this invention are capable of conducting static electrical charges and thereby discharging such charges while avoiding damage to static sensitive components or sparking with uncontrolled discharge of static electricity. This is important in the manufacture of microelectronic elements and in operating rooms or other explosive atmospheres. Another derives from the resistance of the metal fabric to cutting with sharp edged instruments such as knives or scalpels. Such cut resistance can be of substantial significance in such diverse environments as operating rooms and meat processing plants.

Figure 3:
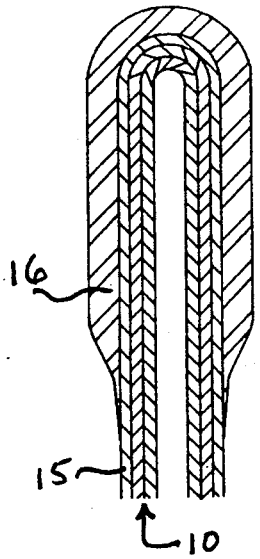
FIG. 3 is a section view, taken generally as if along the line 3—3 in FIG. 2, showing a modified form of the protective garment of FIG. 2.

The present invention contemplates that the protective characteristics of the garments of this invention may be enhanced for certain applications by coating of the fabric of a garment after fabrication of the fabric. Such a modified form is indicated in FIG. 3, a section view taken as if along the line 3—3 in FIG. 1 yet illustrating a form of the invention different from that of FIG. 2. In the modified form, the method of manufacturing the garment further comprises the step of applying to a fabricated product a coating of a fluid impermeable material and/or a coating of a puncture resistant material. In the specific form illustrated, both coating are applied, with a fluid impermeable coating 15 being first applied and then a puncture resistant coating 16 being applied on the fluid impermeable coating. In a preferred form, the fluid impermeable coating 15 is a flexible urethane. In such a form, the puncture resistant coating is a hard urethane. Where both are applied, as for a surgical glove, the flexible, fluid impermeable coating provides a resilient underlayer for the hard, puncture resistant coating and enhances the ability of the harder layer to resist puncture by causing the layer to act as a trampoline. As will be understood, these characteristics enhance the ability of the garment to protect against skin penetration by a suture needle or the like used in surgery. Such skin penetration, as will be appreciated, exposes medical personnel to increased risk of infection. Particularly for a surgical glove, it is preferred that the coating of a fluid impermeable material cover at least a major portion of the body of strand material, while the coating of a puncture resistant material covers at least a minor portion of the body of strand material such as the finger tips where puncture wounds are more likely.

In the drawings and specifications there has been set forth a preferred embodiment of the invention and, although specific terms are used, the description thus given uses terminology in a generic and descriptive sense only and not for purposes of limitation.

What is claimed is:

1. A method of making a protective garment comprising the steps of:

providing a strand material formed by a multifilament bundle of continuous metallic strands entwined with a transitory strand soluble in agents which have substantially no effect on the metallic strands, manipulating the strand material, in a conventional manner which is incapable of manipulating metallic material alone to form a textile fabric and fabricating the textile fabric into a garment, and treating the textile fabric with an agent for removing the transitory strand so as to leave only the multifilament bundle of continuous metallic strands forming the fabric.

2. A method according to claim 1 wherein said step of manipulating strand material comprises knitting the strand material into a fabric.

3. A method according to claim 1 wherein said steps of manipulating strand material and fabricating a garment comprise knitting the strand material into a tubular fabric.

4. A method according to claim 1 wherein said steps of manipulating strand material and fabricating a garment comprise knitting the strand material into a glove.

5. A method according to one of claim 2 or claim 3 or claim 4 wherein the step of knitting comprises passing the strand material through a knitting machine and further comprising the step of lubricating the knitting machine and facilitating manipulation of the strand material by the inclusion of the transitory strand.

6. A method of making a protective glove comprising the steps of:

providing a strand material formed by a multifilament bundle of continuous metallic strands entwined with a transitory strand soluble in agents which have substantially no effect on the metallic strands, and passing the strand material through a conventional knitting machine and knitting the strand material into a glove while lubricating the knitting machine and facilitating manipulation of the strand material by the inclusion of the transitory strand.

7. A method according to one of claim 1 or claim 6 further comprising the step of applying to a fabricated product a coating of a fluid impermeable material.

8. A method according to one of claim 1 or claim 6 further comprising the step of applying to a fabricated product a coating of a puncture resistant material.

9. A method according to one of claim 1 or claim 6 further comprising the step of applying to a fabricated product a coating of a fluid impermeable material and then applying to the coated product a coating of a puncture resistant material.

10. A method according to one of claim 1 or claim 6 further comprising the step of applying to a fabricated product a coating of fluid impermeable, flexible urethane.

11. A method according to one of claim 1 or claim 6 further comprising the step of applying to a fabricated product a coating of puncture resistant, hard urethane.

12. A method according to one of claim 1 or claim 6 further comprising the step of applying to a fabricated product a coating of fluid impermeable, flexible urethane and then applying to the coated product a coating of puncture resistant, hard urethane.

13. The method according to claim 1, wherein said garment is a glove.

* * * * *